US006513406B1

(12) United States Patent
Murray et al.

(10) Patent No.: US 6,513,406 B1
(45) Date of Patent: Feb. 4, 2003

(54) LEVER WITH VIBRATION ISOLATED KNOB

(75) Inventors: Phillip C. Murray, Portland, OR (US); Kai-Ulrich J. Machens, Stuttgart (DE)

(73) Assignee: Freightliner LLC, Portland, OR (US)

( * ) Notice: Subject to any disclaimer, the term of this patent is extended or adjusted under 35 U.S.C. 154(b) by 0 days.

(21) Appl. No.: 09/576,948

(22) Filed: May 22, 2000

(51) Int. Cl.[7] ..... G05G 1/04
(52) U.S. Cl. ..... 74/523; 74/473.29
(58) Field of Search ..... 74/523, 473.29; 403/225, 228, 324.4

(56) References Cited

U.S. PATENT DOCUMENTS

| | | | | | |
|---|---|---|---|---|---|
| 3,693,467 | A | * | 9/1972 | Oehl | 74/473.29 |
| 3,800,909 | A | | 4/1974 | Duncanson et al. | 181/33 A |
| 4,492,129 | A | | 1/1985 | Hasegawa | 74/473 R |
| 4,569,246 | A | | 2/1986 | Katayama et al. | 74/473 R |
| 4,603,598 | A | | 8/1986 | Tsuji et al. | 74/473 R |
| 4,768,393 | A | | 9/1988 | Beaman | 74/473 R |
| 5,025,677 | A | * | 6/1991 | Muller et al. | 74/473.29 |
| 5,189,925 | A | | 3/1993 | Neal et al. | 74/473 R |
| 5,273,120 | A | * | 12/1993 | Chang | 173/162.2 |
| 5,467,664 | A | | 11/1995 | Wehner | 74/523 |
| 5,579,661 | A | | 12/1996 | Yarnell et al. | 74/473 R |

* cited by examiner

*Primary Examiner*—Chong H. Kim
(74) *Attorney, Agent, or Firm*—Klarquist Sparkman LLP

(57) ABSTRACT

A vibration-reducing control lever assembly which in one form comprises a knob, an elastomeric isolator coupled to the knob, and a lever coupled to the elastomeric isolator. The isolator acts as an intermediary between the lever and the knob and reduces vibrations transmitted from the lever to the knob. Thus, the knob is isolated from, rather than directly connected to, the lever. Alternative embodiments include a lever-receiving insert, one or more internal passageways which bypass the elastomeric isolator and a detachable hollow skirt. In some embodiments, the elastomeric isolator is captured and compressed by an isolator receiver.

24 Claims, 1 Drawing Sheet

16
34
38
28
20
52
36
44
26
40
14
42
48
2
2
24
46
22
50
12
32
18
10

30
32
24
30
14
40
42
26
18
12
30
30

LEVER WITH VIBRATION ISOLATED KNOB

FIELD

This invention relates to control levers for powered machines, such as vehicles, and particularly to reducing vibration energy transmitted through such control levers.

BACKGROUND

Control levers are often used to control the operation and movement of different vehicles, such as watercraft, aircraft (e.g., airplanes and helicopters), and ground vehicles (e.g., automobiles, trucks, and motorcycles). Most control levers have knobs connected to their ends.

Operating a vehicle produces vibrations. Vibrations are produced by vehicle engines (e.g., the jet engine of an airplane, the gasoline engine of a car, the diesel engine of a semi-truck), other moving parts of the vehicle (e.g., a drive train), or may be produced as a result of vehicle travel (e.g., waves hitting a boat). Sources of vibration in ground vehicles include vibrations transmitted from tires traveling over the ground or a roadway, and operation of the engine or various other components (e.g., a vehicle transmission).

In vehicles, noise and vibrations may be transmitted from different parts of the vehicle, through the walls of an operator's compartment via control levers, and into the interior of the operator's compartment. For example, in a truck, vibrations from the vehicle's transmission can be transmitted through a gear shift lever and into the truck cab. Such vibrations may be caused by the transmission itself or may be produced in other parts of the vehicle (e.g., by the vehicle engine or other parts of the drive train, by tires travelling along a rough road, etc.) and transmitted through the transmission. Problems created by transmission noise and vibration are especially common in larger ground vehicles (e.g., dump trucks, semi-trucks), since most such vehicles are equipped with a lever which is manually operated to cause shifting of the transmission.

Certain types of mechanisms for dampening noise and vibrations transmitted through gear shift levers are known. Examples are set forth in U.S. Pat. Nos. 5,579,661; 3,800,909 and 5,467,664. However, a need nevertheless exists for an improved vibration isolator for use in lever assemblies.

SUMMARY

A vibration-dampening control lever assembly in one form comprises a knob, an elastomeric isolator coupled to the knob, and a lever coupled to the elastomeric isolator. The assembly may also comprise a lever-receiving insert, one or more internal passageways which bypass the elastomeric isolator, and a detachable hollow skirt. In some forms, the elastomeric isolator is captured and compressed by an isolator receiver.

The knob may define an internal isolator-receiving cavity in the base of the knob which is sized to receive the elastomeric isolator. In such embodiments, the isolator can be mounted directly or indirectly to engage an inside wall of the cavity.

The elastomeric isolator may be a one-piece homogeneous monolithic annular ring of elastomeric material, such as rubber. Alternatively, the elastomeric isolator may be of multi-piece construction, such as comprising two or more isolator fragments.

The lever is typically generally elongated and may comprise a type of control lever for operating or controlling a function of the vehicle, such as the shifting of a transmission. The lever and knob are independently coupled to the elastomeric isolator. Thus, the isolator acts as an intermediary between the lever and the knob and reduces vibrations transmitted from the lever to the knob.

In a specific embodiment, the lever is coupled to a lever-receiving insert, and this insert is coupled to the elastomeric isolator. The insert may include a flange. In a suitable example, the isolator may be positioned within the isolator-receiving cavity of the knob with the insert flange positioned between the elastomeric isolator and the upper wall of the knob defined cavity. In such an embodiment, the flange can be sized to provide resistance to pivoting motion of the knob.

In some embodiments, the knob defines one or more internal passageways which bypass the isolator. These passageways can provide conduits for signal carriers (such as electrical wires or pneumatic lines). These control signal carriers may connect a switch or other control means mounted on the knob to vehicle operating mechanism, such as the transmission of the vehicle.

The assembly may include a hollow skirt detachably mounted to or otherwise coupled to the knob and enclosing a portion of the lever. The skirt may be rigid or flexible, depending on the needs of the vehicle user. The skirt may have a shelf for providing additional support from below to the elastomeric isolator located within the knob cavity.

The elastomeric isolator may be engaged by an isolator receiver with the isolator and receiver being positioned in the knob cavity. The isolator receiver may be annular with upper and lower flanges sized to capture and compress the elastomeric isolator. The receiver may engage an interior wall of the knob cavity.

The present invention is directed toward new and non-obvious aspects of a lever and shift knob isolator alone and in various combinations and sub-combinations thereof and as set forth in the claims below.

DETAILED DESCRIPTION

The present invention relates to a vibration-reducing control lever assembly comprising a control lever coupled to an elastomeric isolator and coupled to a knob.

The elastomeric isolator comprises an elastomeric material, such as rubber. For example, rubber having a durometer of from about 25 to about 75 as measured on the Shore-A scale may be used. A specifically desirable example uses rubber of about 50 on the Shore-A scale for the isolator. Other resilient and elastomeric materials may be used. Alternately, although less desirable, springs may be used.

Figure 1:
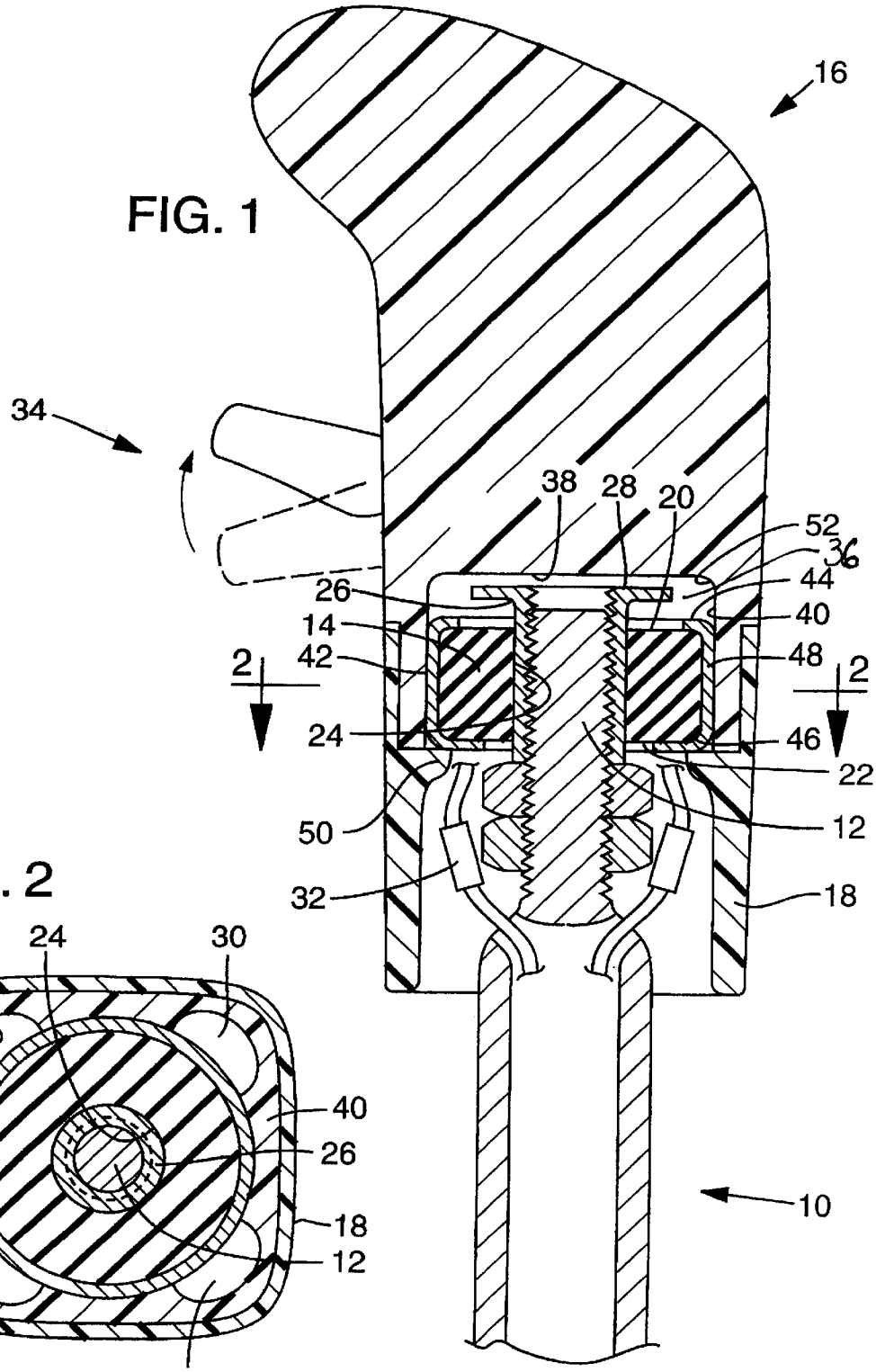
FIG. 1 is a longitudinal sectional view of one embodiment of a control lever assembly.

FIG. 1 illustrates one embodiment of the present invention. A control lever 10, having a first end portion 12, is coupled to a form of elastomeric isolator 14, which is coupled to a knob 16. A hollow skirt 18, enclosing a portion of the lever 10, is also coupled to the knob 16.

The knob 16 is coupled to the elastomeric isolator 14 and indirectly coupled to the first lever end 12 of the control lever 10. Thus, the knob 16 is isolated from, rather than directly and rigidly connected to, the lever 10. As vibrations travel up the lever 10 through the first lever end 12, the isolator 14 reduces or eliminates the vibrations before reaching the knob 16. Reducing vibrations in such a manner offers several advantages, including reducing external noise transmitted by the lever.

The lever may be any control lever generally found in vehicles. The present invention is especially useful with levers subject to frequent or regular vibrations, such as control levers for transmissions.

Figure 2:
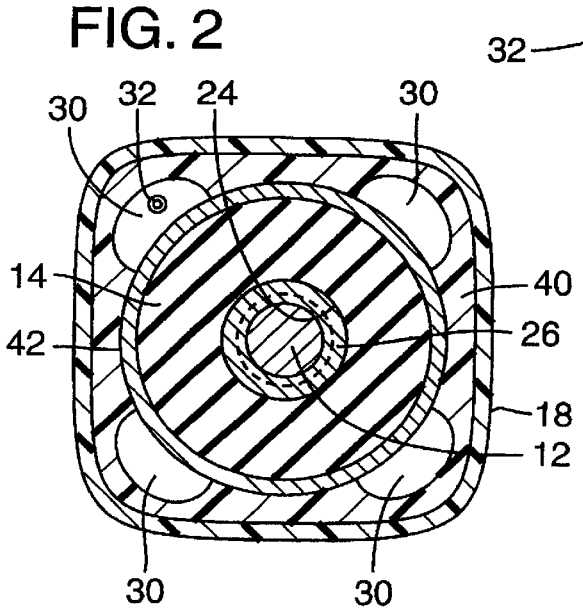
FIG. 2 is a cross-sectional view of the control lever assembly of FIG. 1, taken along line 2-2 of FIG. 1, and showing the assembly with four internal passageways.

In one specific form, the elastomeric isolator comprises a one-piece unitary annular ring, as seen in FIG. 2 (a cross-sectional view is shown in FIG. 1). Alternative embodiments may employ elastomeric isolators having different shapes or thicknesses, however. For example, the elastomeric isolator might be square in cross-section or thinner in longitudinal section. Additionally, the elastomeric isolator may be made from two or more isolator portions or fragments. For example, the isolator of FIG. 2 may comprise four arcuate isolator fragments. The isolator fragments may be spaced apart from or engage each other or be coupled together (e.g., adhesively secured).

In FIG. 1, the elastomeric isolator has a first end surface 20 and a second end surface 22 with an optional centrally located isolator opening 24 (also illustrated in FIG. 2) extending from the first end surface 20 to the second end surface 22. The surfaces 20,22 may be designated upper and lower surfaces when preassembly is in the orientation shown in FIG. 1. The first lever end 12 is inserted through the isolator opening 24 and may extend above the first end surface 20 of the elastomeric isolator 14. In some embodiments, however, the first lever end 12 extends only part way into this isolator opening 24.

As seen in FIG. 2, the illustrated single isolator opening 24 is shown centered within the elastomeric isolator 14. Alternative embodiments may employ such an opening positioned off-center relative to the isolator. Other embodiments may have multiple isolator openings, if desired, for specific lever configurations.

The control lever assembly of FIG. 1 may include a lever-receiving insert 26 with an optional flared end or radially outwardly extending flange 28. The first lever end 12 is coupled in this embodiment to the lever-receiving insert 26. The first lever end could be coupled to the insert in any number of ways. In some embodiments, the first lever end is threadedly coupled to the lever-receiving insert. The lever-receiving insert 26 is sized and shaped to accommodate the first lever end, though the specific size and shape of the insert may vary. For example, the insert 26 pictured in FIGS. 1 and 2 comprises a sleeve that is circular in cross-section. In other embodiments, the insert may have an opening having a cross-section which is square, oval, triangular, polygonal, or any other shape, to facilitate coupling of the insert to the first lever end.

The lever assembly may also include a knob which defines one or more internal passageways 30 which bypass the isolator 14. If two or more passageways are present, they may be positioned at spaced intervals around the knob. For example, FIG. 2 illustrates four such passageways 30 positioned at spaced intervals within the base of a knob 16 having a square cross-section. One function of a passageway is to provide a conduit for one or more signal conductors 32, such as a pneumatic line, an electrical wire, or optical fiber. An internal passageway thus allows one or more signal conductors to be placed inside the control lever assembly, rather than mounted on the outside of the assembly. The use of an internal passageway thus helps protect such signal conductors from damage. The present invention does not require a signal conductor 32 positioned within each passageway 30, or in any passageway 30. However, two or more such signal conductors 32 may be positioned within the same passageway 30.

The knob may be almost any size or shape, and may assume the exterior shape of commercially available knobs for levers. The knob 16 pictured in FIG. 1 is of an exterior shape typical of knobs used for vehicle transmissions. The knob may also include a control means for controlling some aspect of vehicle operation. For example, the knob 16 of FIG. 1 includes a switch 34. The switch 34 is coupled to the signal conductor 32, which transmits a signal from the switch 34 to some other part of the vehicle (not shown). For example, the control lever assembly of FIG. 1 could be a control lever for a vehicle transmission, and the switch could control the operation of a transmission overdrive.

The knob 16 of FIG. 1 includes an isolator-receiving cavity 36 sized to receive the elastomeric isolator 14. The isolator-receiving cavity may also be sized to receive other parts of the control lever assembly, such as the lever-receiving insert 26 (with or without the insert flange 28), the first end of the control lever 12, and signal carrying conductor 32. The isolator-receiving cavity may have an upper wall 38 and may have one or more side walls 40. In the embodiment illustrated by FIGS. 1 and 2, the knob base is square in cross-section and has four side-walls 40 that, in part, define the internal passageways 30 described above. In alternative embodiments, the knob base is circular in cross-section with only one side wall. In other embodiments, the isolator-receiving cavity may be dome-shaped with one continuous wall.

The embodiment pictured in FIG. 1 includes a lever-receiving insert 26 with a flange 28 spaced between the isolator 14 and the upper wall 38 of the isolator-receiving cavity 36. The flange 28 is positioned close to the upper wall and may engage the upper wall 38 if sufficient pivoting or rotational force is applied to the knob 16. Thus, the flange 28 may provide some resistance to such rotational force.

In FIG. 1, the knob 16 is coupled to the elastomeric isolator 14 by an isolator receiver 42 having an exterior wall surface which is positioned in engagement with portions of the side wall 40 of the isolator-receiving cavity 36. The isolator receiver 42 may be removably or permanently coupled to the side wall 40 of the cavity 36. For example, receiver 42 may be press fit into the knob or adhesively or mechanically secured in place. The isolator receiver 42 of FIG. 1 may be held in engagement with the side wall by other means, such as by a support portion of a hollow skirt (as described below).

In the form shown, the isolator receiver 42 of FIGS. 1 and 2 is typically configured to match or correspond to the shape of the isolator. Thus, receiver 42 may be annular in shape with a first flange 44, adjacent the first end surface 20 of the elastomeric isolator 14, and a second flange 46, adjacent the second end surface 22 of the elastomeric isolator 14. A receptacle wall 48, positioned in this example in engagement with at least portions of the side wall 40 of the isolator-receiving cavity 42 of the knob 16, extends between the first flange 44 and second flange 46. In FIG. 1, the isolator receiver may be held in place by a support portion 50 of the hollow skirt 18 in the form of an inwardly projecting shelf, supporting the receiver from below. A curved portion 52 connecting a side wall 40 and the upper wall 38 of the isolator-receiving cavity 36 acts as a form of a stop and similarly holds the isolator receiver 42 in place from above.

The isolator receiver 42 of FIG. 1 may be sized to snugly retain the isolator in place or may capture and compress the isolator. A captured and compressed elastomeric isolator may provide more rigidity during movement of the knob and lever, while still able to dampen vibrations transmitted by the lever.

The FIG. 1 embodiment again is shown with a hollow skirt 18 enclosing a portion of the lever 10. The hollow skirt 18 may be permanently or detachably mounted to the knob 16, and may be rigid or flexible. Also, a narrow, rigid skirt coupled to the knob may be sized to engage the lever if sufficient rotational or pivoting force is applied to the knob. Such a skirt would thereby limit the application of excessive rotational force or pivoting forces placed on the isolator.

While the present invention is described above in connection with at least one exemplary embodiment, it will be readily understood that the scope of the present invention is not intended to be limited to this embodiment. Instead, the invention encompasses all alternatives, modifications, and equivalents that may be included within the spirit and scope of the invention as defined by the claims.

We claim:

1. A lever assembly comprising:

a knob;

an elastomeric isolator coupled to the knob and having first and second end surfaces, the isolator defining an isolator opening, the isolator opening extending from the first end surface to the second end surface, wherein the knob defines at least one internal passageway which bypasses the elastomeric isolator;

a lever-receiving insert extending into the isolator opening; and a lever having a first end portion, the lever-receiving insert being coupled to the first end portion of the lever.

2. The assembly of claim 1, wherein the knob defines at least two such passageways positioned at spaced apart locations of the knob and relative to the elastomeric isolator.

3. The assembly of claim 2 in which the knob has a square cross section with corners and defines four such passageways positioned adjacent to the corners of the knob.

4. The assembly of claim 1 in which at least one signal carrier is positioned within the at least one internal passageway.

5. The assembly of claim 4 wherein the at least one signal carrier is selected from the group consisting of an electrical signal carrier and a pneumatic signal carrier.

6. A lever assembly comprising:

a knob;

an elastomeric isolator coupled to the knob and having first and second end surfaces, the isolator defining an isolator opening, the isolator opening extending from the first end surface to the second end surface;

a lever-receiving insert extending into the isolator opening; and a lever having a first end portion, the lever-receiving insert being coupled to the first end portion of the lever;

wherein the knob defines an isolator-receiving cavity sized to receive the elastomeric isolator, the interior of the cavity having an upper wall and at least one side wall;

an isolator receiver which receives the elastomeric isolator and is positioned in engagement with the side wall of the isolator receiving cavity; and wherein the isolator receiver is annular and has a first flange adjacent to the first end surface of the elastomeric isolator, a second flange adjacent to the second end surface of the elastomeric isolator, and a receiver wall extending between the first and second flanges and positioned in engagement with the side wall of the isolator receiving cavity.

7. A lever assembly comprising:

a knob;

an elastomeric isolator coupled to the knob and having first and second end surfaces, the isolator defining an isolator opening, the isolator opening extending from the first end surface to the second end surface;

a lever-receiving insert extending into the isolator opening;

a lever having a first end portion, the lever-receiving insert being coupled to the first end portion of the lever; and wherein the lever is threadedly coupled to the lever-receiving insert.

8. A lever assembly comprising:

a knob;

an elastomeric isolator coupled to the knob and having first and second end surfaces, the isolator defining an isolator opening, the isolator opening extending from the first end surface to the second end surface;

a lever-receiving insert extending into the isolator opening; and a lever having a first end portion, the lever-receiving insert being coupled to the first end portion of the lever;

a skirt comprising a support portion positioned to support the elastomeric isolator; and an isolator receiver which receives the elastomeric isolator and insert, the skirt having a support in the form of an inwardly projecting shelf positioned to support the isolator receiver from below.

9. A lever assembly comprising:

a knob coupled to an isolator assembly; and a lever having a first end portion coupled to the isolator assembly, the isolator assembly further comprising;

an elastomeric isolator coupled to the first lever end portion; and an isolator receiver, the elastomeric isolator being compressed and captured by the isolator receiver; and in which the knob defines at least one internal passageway which bypasses the elastomeric isolator.

10. A lever assembly comprising:

a knob;

an elastomeric isolator coupled to the knob;

a lever having a first end portion, the isolator being coupled to the first end portion of the lever; and at least one internal passageway which bypasses the elastomeric isolator.

11. The assembly of claim 10 in which the isolator is annular.

12. The assembly of claim 10 further comprising a lever-receiving insert extending through the isolator, the lever-receiving insert being coupled to the first end portion of the lever.

13. The assembly of claim 12 including an annular isolator receiver which is sized and positioned to at least partially compress the isolator, the isolator being spaced from the knob by the lever-receiver insert and the isolator receiver.

14. A lever assembly comprising:

a knob defining a cavity having an upper wall and at least one side wall;

an isolator receiver positioned to engage at least one side wall of the knob cavity;

an elastomeric isolator having first and second end surfaces with a central opening extending from the first end surface to the second end surface, the elastomeric isolator being compressed and captured by the isolator receiver;

an insert comprising at least one flange, the insert extending through the elastomeric isolator opening, the at least one flange spaced between the first elastomeric isolator end surface and the upper wall of the knob cavity;

at least one internal passageway which bypasses the elastomeric isolator;

a signal carrier extending through the internal passageway;

a lever having a first end portion, the first end portion extending through and coupled to the insert, the elastomeric isolator surrounding at least a portion of the lever; and a hollow skirt detachably mounted to the knob, the skirt enclosing at least a portion of the lever and including a shelf positioned to support the isolator receiver and thereby the elastomeric isolator from below.

15. The assembly of claim 1 wherein the insert extends through the isolator opening.

16. The assembly of claim 15 wherein the insert extends entirely through the isolator opening.

17. The assembly of claim 7 wherein the insert extends through the isolator opening.

18. The assembly of claim 17 wherein the insert extends entirely through the isolator opening.

19. The lever assembly of claim 7 wherein the lever-receiving insert comprises a flange.

20. The lever assembly of claim 18 wherein the knob defines at least one internal passageway which bypasses the elastomeric isolator.

21. The lever assembly of claim 20 wherein the knob defines at least two internal passageways positioned at spaced apart locations of the knob and relative to the elastomeric isolator.

22. The lever assembly of claim 19 wherein the knob has a substantially square cross section with corners and defines four such passageways positioned adjacent to the corners of the knob.

23. The lever assembly of claim 19 wherein at least one signal carrier is positioned within the at least one internal passageway.

24. The lever assembly of claim 17 wherein the knob defines an isolator-receiving cavity sized to receive the elastomeric isolator, the interior of the cavity having, an upper wall and at least one side wall.

* * * * *